US009751306B2

(12) United States Patent
Sato et al.

(10) Patent No.: US 9,751,306 B2
(45) Date of Patent: Sep. 5, 2017

(54) PIEZOELECTRIC DEVICE, LIQUID EJECTING HEAD AND METHOD FOR MANUFACTURING PIEZOELECTRIC DEVICE

(71) Applicant: SEIKO EPSON CORPORATION, Tokyo (JP)

(72) Inventors: Naoya Sato, Chino (JP); Shuichi Tanaka, Chino (JP); Masashi Yoshiike, Chino (JP); Naohiro Nakagawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/205,065

(22) Filed: Jul. 8, 2016

(65) Prior Publication Data

US 2017/0028726 A1 Feb. 2, 2017

(30) Foreign Application Priority Data

Jul. 28, 2015 (JP) ..... 2015-148371

(51) Int. Cl.
*B41J 2/14* (2006.01)
*B41J 2/16* (2006.01)

(52) U.S. Cl.
CPC ..... *B41J 2/14201* (2013.01); *B41J 2/14072* (2013.01); *B41J 2/14233* (2013.01); *B41J 2/161* (2013.01); *B41J 2/1623* (2013.01); *B41J 2/1626* (2013.01); *B41J 2/1631* (2013.01); *B41J 2/1632* (2013.01); *B41J 2/1643* (2013.01); *B41J 2002/14362* (2013.01); *B41J 2002/14491* (2013.01); *B41J 2202/18* (2013.01)

(58) Field of Classification Search
CPC ..... B41J 2/14201; B41J 2/14233; B41J 2002/14491; B41J 2202/18; B41J 2/14072
See application file for complete search history.

(56) References Cited

U.S. PATENT DOCUMENTS

2005/0239233 A1* 10/2005 Shinkai ..... B41J 2/14209 438/106

FOREIGN PATENT DOCUMENTS

JP 2014-051008 A 3/2014
WO WO 2012/176875 A 12/2012

* cited by examiner

*Primary Examiner* — Geoffrey Mruk
(74) *Attorney, Agent, or Firm* — Workman Nydegger

(57) ABSTRACT

A piezoelectric device includes a first substrate having a piezoelectric element on one surface thereof and a second substrate having penetration wiring that includes a through hole formed in a thickness direction thereof and a conductor section formed in the through hole. A resin section is formed on a surface of one substrate of one of the first substrate and the second substrate, which opposes the other substrate, and is formed of an elastic body in a shape protruding toward the other substrate, and a first electrode layer is formed on the surface of the other substrate side of the resin section. A second electrode layer is formed on a surface of the other substrate that opposes the one substrate, and the first substrate and the second substrate are joined in a state in which the first electrode layer and the second electrode layer are abutting against each other.

6 Claims, 5 Drawing Sheets

PIEZOELECTRIC DEVICE, LIQUID EJECTING HEAD AND METHOD FOR MANUFACTURING PIEZOELECTRIC DEVICE

CROSS-REFERENCE TO RELATED APPLICATIONS

The present application claims priority to Japanese Patent Application No. 2015-148371 filed on Jul. 28, 2015, which is hereby incorporated by reference in its entirety.

BACKGROUND

1. Technical Field

The present invention relates to a piezoelectric device that is provided with a first substrate on which a first electrode layer is formed, and a second substrate on which a second electrode layer that is electrically connected to the first electrode layer, is formed, a liquid ejecting head and a method for manufacturing a piezoelectric device.

2. Related Art

Piezoelectric devices are provided with piezoelectric elements, and are applied to various liquid ejecting apparatuses, vibration sensors, and the like. For example, in liquid ejecting apparatuses, various liquids are ejected (discharged) from a liquid ejecting head using piezoelectric devices. Image recording apparatuses such as ink jet printers and ink jet plotters are examples of such liquid ejecting apparatuses, but in recent years, liquid ejecting apparatuses have been applied to various manufacturing apparatuses to make use of the feature of being able to accurately land a very small quantity of liquid in a predetermined position. For example, liquid ejecting apparatuses have been applied to display manufacturing apparatuses that manufacture color filters for liquid crystal displays, electrode formation apparatuses that form electrodes for organic Electro Luminescence (EL) displays and Field Emission Displays (FEDs), and chip manufacturing apparatuses that manufacture biochips (biochemical elements). Further, recording heads of image recording apparatuses eject liquid ink, and color material ejecting heads of display manufacturing apparatuses eject solutions of each color material of Red (R), Green (G), and blue (B). In addition, electrode material ejecting heads of electrode formation apparatuses eject materials of liquid electrode, and living organic material ejecting heads of chip manufacturing apparatuses eject solutions of living organic material.

The abovementioned liquid ejecting heads are formed by laminating a pressure-chamber-defining substrate that has a pressure chamber communicating with a nozzle, a piezoelectric element (a kind of actuator) that causes pressure fluctuations to be generated in liquid inside the pressure chamber, a sealing plate that is stacked over the piezoelectric element with a certain gap therebetween, and the like. Further, the above-mentioned piezoelectric element is driven by a driving signal that is supplied from a driving IC (also referred to as a driver IC). As an example of such a liquid ejecting head, International Publication No. 2012/176875 has disclosed a liquid ejecting head having a driving IC, a Tape Carrier Package (TCP) containing a driving IC, and the like. This driving IC, TCP, or the like is connected to an upper surface, which is opposite to a lower surface facing a piezoelectric element, and a driving signal from the driving IC is supplied to the piezoelectric element via wiring that is formed on the upper and lower surfaces of the sealing plate, penetration wiring that is formed inside a through hole in the sealing plate, and bumps that electrically connect a pressure-chamber-defining substrate and a sealing plate.

Solder bumps containing solder and metal bumps made from a metal (for example, gold or the like) are known as bumps that electrically connect two substrates. However, since it is difficult to suppress wet-spreading of the molten solder bumps, and thus it is difficult to form minute electrodes, solder bumps are not suitable for miniaturization of the liquid ejecting heads. Therefore, the use of metal bumps that can be formed in a semiconductor process (that is, a film formation process, a photolithography process, an etching process, or the like) without melting has been considered. However, since the rigidity of metal bumps is high, in order to electrically connect the metal bump reliably, the pressure applied to the substrates in a joining process becomes excessively high. Therefore, there is a concern that the substrates may be damaged. In particular, the sealing plate becomes vulnerable to breakage since the through holes for forming the penetration wiring is formed in the sealing plate.

SUMMARY

An advantage of some aspects of the invention is to provide a piezoelectric device that can suppress a circumstance in which the substrates break when joining a first substrate on which a first electrode layer is formed, and a second substrate on which a second electrode layer that is electrically connected to the first electrode layer, is formed, a liquid ejecting head and a method for manufacturing a piezoelectric device.

According to an aspect of the invention, there is provided a piezoelectric device including a first substrate having a piezoelectric element on one surface thereof and a second substrate having penetration wiring that includes a through hole formed in a thickness direction thereof and a conductor section formed in the through hole. A resin section is formed on a surface of one substrate of one of the first substrate and the second substrate, which opposes the other substrate, and is formed of an elastic body in a shape protruding toward the other substrate, and a first electrode layer is formed on the surface of the other substrate side of the resin section. A second electrode layer, which is electrically connected to the first electrode layer, is formed on a surface of the other substrate that opposes the one substrate, and the first substrate and the second substrate are joined in a state in which the first electrode layer and the second electrode layer are abutting against each other.

According to this configuration, since the first electrode layer is formed on the front surface of the resin section, which has an elastic property, when joining the first substrate and the second substrate, it is possible secure a joining area of the first electrode layer and the second electrode layer and electrically connect the first electrode layer and the second electrode layer more reliably as a result of elastic deformation of the resin section. As a result of this, it is possible to reduce an amount of pressure (a load) that is applied between the first substrate and the second substrate, which is required for electrical connection of the first electrode layer and the second electrode layer. As a result, it is possible to suppress breaking of the substrates.

In addition, in the abovementioned configuration, it is preferable that a curved surface of the resin section and the first electrode layer opposing the other substrate includes a portion that is curved in an arc shape.

According to this configuration, it is possible to further reduce a pressure that is applied between the first substrate and the second substrate.

Furthermore, in the abovementioned configuration, it is preferable that the resin section and the first electrode layer are formed on the first substrate, and the second electrode layer is formed on the second substrate.

According to this configuration, even if heat is applied during formation of the resin section, since the heat is transmitted to the first substrate, it is possible to suppress a circumstance in which the second substrate breaks as a result of a difference in the linear expansion coefficients of the second substrate and the conductor section of the penetration wiring.

In addition, according to another aspect of the invention, there is provided a liquid ejecting head including the piezoelectric devices with the above-mentioned configurations.

Furthermore, according to still another aspect of the invention, there is provided a method for manufacturing a piezoelectric device that is formed by joining a first substrate having a piezoelectric element on one surface thereof and a second substrate having penetration wiring that includes a through hole formed in a thickness direction thereof, and a conductor section formed in the through hole, the method including forming a resin section, which is formed of an elastic body in a protruding shape on a surface of one of the first substrate and the second substrate, forming a first electrode layer on a surface of a side of the resin section that is opposite to the one substrate, forming a second electrode layer in a region of the other substrate that corresponds to a region of the first electrode layer, and joining the first substrate and the second substrate in a state in which the first electrode layer and the second electrode layer are abutting against each other.

According to this method, since the first electrode layer is formed on the front surface of the resin section, which has an elastic property, when joining the first substrate and the second substrate, it is possible secure a joining area of the first electrode layer and the second electrode layer and electrically connect the first electrode layer and the second electrode layer as a result of elastic deformation of the resin section. As a result of this, it is possible to reduce an amount of pressure that is applied between the first substrate and the second substrate, which is required for electrical connection of the first electrode layer and the second electrode layer.

In addition, in the above-mentioned method, it is preferable that the forming of a resin section includes forming a curved surface on the surface of a side of the resin section that is opposite to the one substrate, the curved surface having a portion that is curved in an arc shape.

According to this configuration, when joining the first substrate and the second substrate, it is possible to further suppress a pressure that is applied between the first substrate and the second substrate.

Furthermore, in the above-mentioned method, it is preferable that the resin section and the first electrode layer are formed on the first substrate, and the second electrode layer is formed on the second substrate.

According to this method, even if heat is applied to a resin section when forming the resin section, since the heat is transmitted to the first substrate, it is possible to suppress a circumstance in which the second substrate breaks as a result of a difference in the linear expansion coefficients of the second substrate and the conductor section of the penetration wiring.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, aspects for implementing the invention will be described with reference to the attached drawings. Additionally, since the embodiments that are mentioned below are preferred specific examples of the invention, various limitations have been applied thereto, but the scope of the invention is not limited to these aspects unless a feature that specifically limits the invention is disclosed in the following description. In addition, in the following description, examples of an ink jet type recording head (hereinafter, referred to as a recording head), which is a type of a liquid ejecting head, that is provided with the piezoelectric device according to the invention, and an ink jet type printer (hereinafter, referred to as a printer), which is a type of liquid ejecting apparatus, in which such an ink jet type recording head is mounted, are illustrated.

Figure 1:
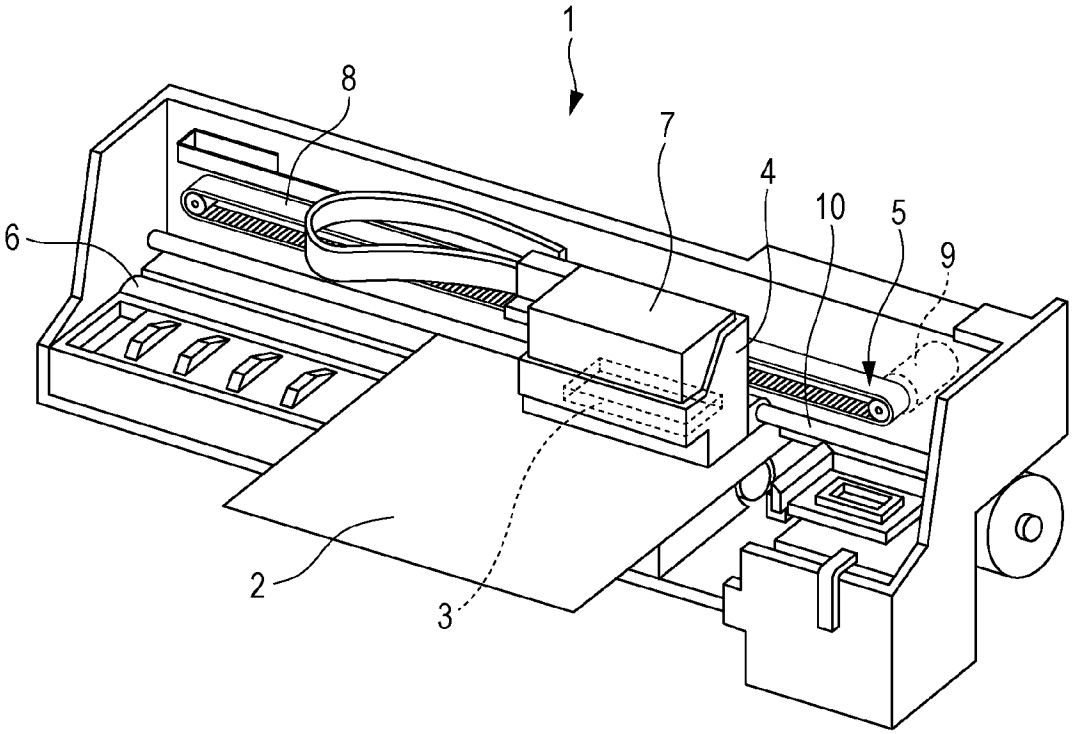
FIG. 1 is a perspective view that describes a configuration of a printer.

A configuration of a printer 1 will be described with reference to FIG. 1. The printer 1 is an apparatus that performs the recording of images or the like by ejecting an ink (a type of liquid) onto a front surface of a recording medium 2 (a type of landing target) such as recording paper. The printer 1 is provided with a recording head 3, a carriage 4 to which the recording head 3 is attached, a carriage movement mechanism 5 that moves the carriage 4 in a main scanning direction, and a transport mechanism 6 that transfers the recording medium 2 in a sub-scanning direction. In this instance, the abovementioned ink is stored in ink cartridges 7 as liquid supply sources. The ink cartridges 7 are removably installed in the recording head 3. Additionally, it is possible to adopt a configuration in which the ink cartridges are disposed on a main body side of the printer, and ink is supplied to the recording head from the ink cartridges through an ink supply tube.

The carriage movement mechanism 5 is provided with a timing belt 8. Further, the timing belt 8 is driven by a pulse motor 9 such as a DC motor. Accordingly, when the pulse motor 9 is operated, the carriage 4 reciprocates in the main scanning direction (a width direction of the recording medium 2) guided on a guide rod 10, which is provided in a hanging manner in the printer 1. The position of the carriage 4 in the main scanning direction is detected by a linear encoder (not illustrated in the drawing), which is a type of positional information detection means. The linear encoder sends a driving signal thereof, that is, an encoder pulse (a type of positional information) to a control section of the printer 1.

Figure 2:
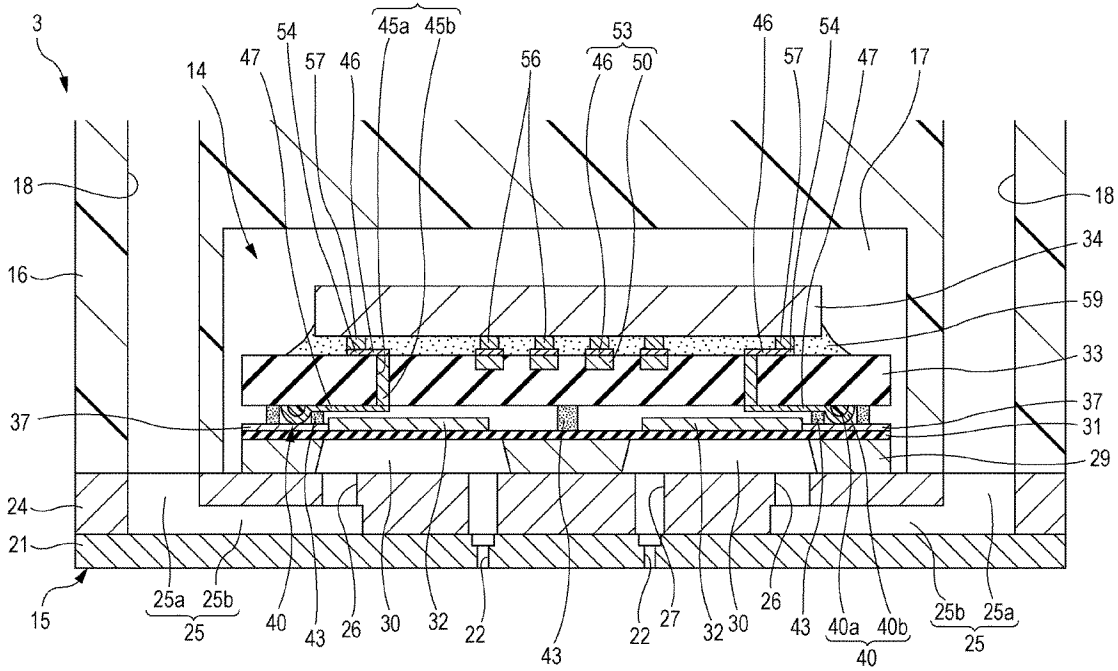
FIG. 2 is a cross-sectional view that describes a configuration of a recording head.
Figure 3:
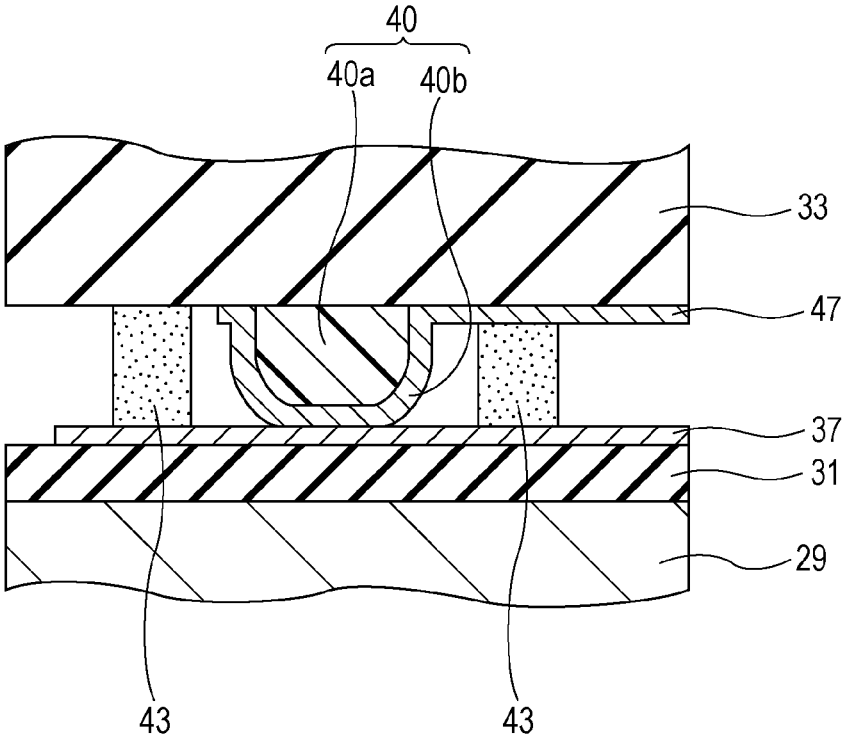
FIG. 3 is a cross-sectional view in which the main parts of the recording head are enlarged.

Next, the recording head 3 will be described. FIG. 2 is a cross-sectional view that describes a configuration of the recording head 3. FIG. 3 is a cross-sectional view in which the main parts of the recording head 3 are enlarged, and is a cross-sectional view that describes a joining section of a resin core bump 40. As shown in FIG. 2, the recording head 3 in the embodiment is attached to a head case 16 in a state in which a piezoelectric device 14 and a flow channel unit 15 are laminated. Additionally, for the convenience of description, the lamination direction of each member will be described as the up-down direction.

The head case 16 is a synthetic resin box-shaped member, and liquid introduction paths 18 that supply ink to common liquid chambers 25, which will be described later, are formed in an inner section thereof. The liquid introduction paths 18 are spaces in which ink that is common to pressure chambers 30 that are arranged in a plurality, is stored in addition to the common liquid chambers 25. In the present embodiment, two liquid introduction paths 18 are provided to correspond to a row of pressure chambers 30 in which two pressure chambers 30 are arranged in parallel. In addition, an accommodation space 17, which is recessed in a rectangular parallelepiped shape from a lower surface side of the head case 16 to midway in a height direction of the head case 16, is formed between the two liquid introduction paths 18. A piezoelectric device 14 (a pressure-chamber-defining substrate 29, a sealing plate 33, and the like), which is laminated on a communication substrate 24, is accommodated inside the accommodation space 17.

The flow channel unit 15, which is joined to the lower surface of the head case 16, includes the communication substrate 24, and a nozzle plate 21. The communication substrate 24 is a plate material that is manufactured using silicon, and in the present embodiment, is prepared from a monocrystalline silicon substrate in which the azimuth of the crystal plane of the front surface (the upper surface and the lower surface) is set as (110). As shown in FIG. 2, the common liquid chambers 25, that are in communication with the liquid introduction paths 18, and in which ink that is common to each pressure chambers 30 is stored, and individual communication channels 26 that individually supply ink from the liquid introduction paths 18 to each pressure chambers 30 via the common liquid chambers 25, are formed in the communication substrate 24 using etching. The common liquid chambers 25 are longitudinal space sections along a nozzle row direction, and two rows of the common liquid chambers 25 are formed to correspond to a row of pressure chambers 30 in which two pressure chambers 30 are arranged in parallel. The common liquid chambers 25 are configured by a first liquid chamber 25*a* that penetrates through the thickness direction of the communication substrate 24, and a second liquid chamber 25*b* that is formed in a state in which a thin plate section remains by recessing from the lower surface side of the communication substrate 24 toward the upper surface side up to midway in the thickness direction of the communication substrate 24. The individual communication channels 26 are formed in a plurality on the thin plate section of the second liquid chamber 25*b* along a parallel arrangement direction of the pressure chambers 30 to correspond to the pressure chambers 30. The individual communication channels 26 are in communication with an end section of one side in the longitudinal direction of a corresponding pressure chamber 30 in a state in which the communication substrate 24 and the pressure-chamber-defining substrate 29 are joined.

In addition, nozzle communication channels 27, which penetrate through the thickness direction of the communication substrate 24, are formed in positions that correspond to each nozzle 22 of the communication substrate 24. That is, the nozzle communication channels 27 are formed in plurality along a nozzle row direction that corresponds to a nozzle row. The pressure chambers 30 and the nozzles 22 are in communication with one another due to these nozzle communication channels 27. The nozzle communication channels 27 of the present embodiment are in communication with an end section of the other side in the longitudinal direction of a corresponding pressure chamber 30 (a side that is opposite to the individual communication channel 26) in a state in which the communication substrate 24 and the pressure-chamber-defining substrate 29 are joined.

The nozzle plate 21 is a substrate manufactured from silicon (for example, a monocrystalline silicon substrate), which is joined to the lower surface of the communication substrate 24 (a surface on a side that is opposite to the pressure-chamber-defining substrate 29). In the present embodiment, openings that are on a lower surface side of the spaces that correspond to the common liquid chambers 25 are sealed by the nozzle plate 21. In addition, a plurality of nozzles 22 are provided in an open manner in the nozzle plate 21 in a linear manner (row form). In the present embodiment, two nozzle rows are formed to correspond to a row of pressure chambers 30 in which two pressure chambers 30 are formed. A plurality of nozzles 22 that are arranged in parallel (a nozzle row) are provided at regular intervals along the sub-scanning direction, which is orthogonal to the main scanning direction, from a nozzle 22 of one end side to a nozzle 22 of the other end side with a pitch (for example, 600 dpi) that corresponds to a dot formation density. Additionally, it is also possible to seal the openings that are on the lower surface side of the spaces that correspond to the common liquid chambers with a member such as a compliance sheet that has a flexible property, for example, by joining the nozzle plate to a region of the communication substrate that is separated on the inner side from the common liquid chambers. If configured in this manner, it is possible to make the nozzle plate as small as possible.

As shown in FIG. 2, the piezoelectric device 14 of the present embodiment is unitized by laminating the pressure-chamber-defining substrate 29, a vibration plate 31, piezoelectric elements 32, the sealing plate 33, and a driving IC 34, and is accommodated inside the accommodation space 17.

The pressure-chamber-defining substrate 29 is a hard silicon plate material, and in the present embodiment, is prepared from a monocrystalline silicon substrate in which the azimuth of the crystal plane of the front surface (the upper surface and the lower surface) is set as (110). A plurality of spaces, which correspond to the pressure chambers 30, are arranged in parallel in the pressure-chamber-defining substrate 29 along the nozzle row direction, as a result of portions being completely removed in the thickness direction by etching. The spaces configure the pressure chambers 30 as a result of the lower sections thereof being partitioned by the communication substrate 24, and the upper sections thereof being partitioned by the vibration plate 31. In addition, the spaces, that is, the pressure chambers 30 are formed in two rows to correspond to the nozzle rows that are formed in two rows. Each pressure chamber 30 is formed longitudinally in a direction that is orthogonal to the nozzle row direction, an individual communication channel 26 is in communication with the end section of one side in the longitudinal direction, and a nozzle communication channel 27 is in communication with the end section of the other side.

The vibration plate 31 is a thin film form member that has an elastic property, and is laminated onto an upper surface of the pressure-chamber-defining substrate 29 (a surface on a side that is opposite to the communication substrate 24). Upper section openings of the spaces that correspond to the pressure chambers 30 are sealed by the vibration plate 31. In other words, the upper surfaces of the pressure chambers 30 are partitioned by the vibration plate 31. Portions of the vibration plate 31 that correspond to the pressure chambers 30 (or to explain in more detail, the upper section openings of the pressure chambers 30) function as displacement sections that are displaced in a direction that becomes distant from or a direction that approaches the nozzles 22 in accordance with deflection deformation of the piezoelectric elements 32. That is, regions of the vibration plate 31 that correspond to the upper section openings of the pressure chambers 30 correspond to driving regions in which deflection deformation is permitted. The cubic capacity of the pressure chambers changes depending on the deformation (displacement) of the driving regions (displacement sections). Meanwhile, regions of the vibration plate 31 that are separated from the upper section openings of the pressure chambers 30 correspond to non-driving regions in which deflection deformation is inhibited.

Additionally, the vibration plate 31 is, for example, formed from an elastic film that is formed from silicon dioxide ($SiO_2$) formed on an upper surface of the pressure-chamber-defining substrate 29, and an insulating body film that is formed from zirconium oxide ($ZrO_2$) formed on the elastic film. Further, the piezoelectric elements 32 are respectively laminated formed on the insulating film (a surface of the vibration plate 31 on a side that is opposite to the pressure-chamber-defining substrate 29) in regions (that is, the driving regions) that correspond to each pressure chamber 30. Each piezoelectric element 32 is formed in two rows along the nozzle row direction to correspond to the pressure chambers 30 that are arranged in parallel in two rows along the nozzle row direction. Additionally, the pressure-chamber-defining substrate 29 and the vibration plate 31 that is laminated thereon, correspond to the first substrate of the invention.

The piezoelectric elements 32 of the present embodiment, are so-called deflection mode piezoelectric elements. In the piezoelectric elements 32, a lower electrode layer, a piezoelectric body layer, and an upper electrode layer are sequentially laminated onto the vibration plate 31. When an electric field depending on a difference in potential between the two electrodes is applied between the lower electrode layer and the upper electrode layer, deflection deformation of the piezoelectric elements 32 that are configuration in this manner occurs in a direction that becomes distant from or approaches the nozzles 22. As shown in FIG. 2, driving wiring 37 (corresponds to the second electrode layer of the invention) is routed from each piezoelectric element 32 to further on an outer side than the piezoelectric element 32 (that is, to a non-driving region). That is, the driving wiring 37 is formed on a surface of the vibration plate 31 that opposes the sealing plate 33. The driving wiring 37 is wiring that supplies a driving signal for driving the piezoelectric elements 32 to the piezoelectric elements 32, and runs along a direction that is orthogonal to the nozzle row direction (that is, the parallel arrangement direction of the piezoelectric elements 32) from the piezoelectric elements 32 to an end section of the vibration plate 31. Additionally, the driving wiring 37 is, for example, formed from gold (Au), titanium (Ti), aluminum (Al) chromium (Cr), nickel (Ni), copper (Cu), an alloy thereof, or the like.

As shown in FIG. 2, sealing plates 33 (correspond to the second substrate of the invention) are flat plate form substrates that are arranged spaced apart with respect to the vibration plate 31 (or the piezoelectric elements 32). In the present embodiment, the sealing plates 33 are prepared from a monocrystalline silicon substrate in which the azimuth of the crystal plane of the front surface (the upper surface and the lower surface) is set as (110). The driving IC 34, which outputs driving signals for driving the piezoelectric elements 32, is disposed on the upper surfaces of the sealing plates 33 (surfaces on a side that is opposite to the side of the piezoelectric elements 32). In addition, a plurality of resin core bumps 40, which output the driving signals from the driving IC 34 to a side of the piezoelectric elements 32, are formed on the lower surfaces of the sealing plates 33 (surfaces on a side of the piezoelectric elements 32). As shown in FIG. 2, the resin core bumps 40 are formed in a plurality along the nozzle row direction in a position that corresponds to one piece of driving wiring 37 that runs from a row of one piezoelectric element 32, and a position that corresponds to the other piece of driving wiring 37 that runs from a row of the other piezoelectric element 32. Further, each resin core bump 40 is connected to a respective corresponding driving wiring 37.

The resin core bumps 40 in the present embodiment have an elastic property, and are formed in regions of the sealing plate 33 that correspond to the driving wiring 37 in a shape protruding toward a side of the vibration plate 31. More specifically, as shown in FIG. 3, the resin core bumps 40 are provided with a resin section **40*a* that is formed from an elastic body and is formed in a shape protruding toward a side of the vibration plate 31, and an electrode layer 40*b* (corresponds to the first electrode layer of the invention) that is formed along the front surface of a side of the vibration plate 31 of the resin section 40*a*. In the present embodiment, the resin section 40*a* is formed into a protrusion along the nozzle row direction on the lower surface of the sealing plate 33. In addition, the electrode layer 40*b* is formed in a plurality along the nozzle row direction to correspond to the piezoelectric elements 32 that are arranged in parallel along the nozzle row direction. That is, the resin core bumps 40 are formed in a plurality along the nozzle row direction corresponding to the piezoelectric elements 32. Further, the surfaces of the sides of the resin section 40*a* and the electrode layer 40*b* that oppose the driving wiring 37 (the lower surfaces of the resin core bumps 40) are formed curved in an arc shape toward a side of the pressure-chamber-defining substrate 29 in a cross-sectional view in a direction that is orthogonal the nozzle row direction. Such resin core bumps 40 are electrically connected to the driving wiring 37 as a result of a portion of the arc shape of the lower surface being elastically deformed by being pushed against a corresponding driving wiring 37**.

Additionally, a resin that has an elastic property, and, for example, is formed from a polyimide resin, a phenol resin, an epoxy resin, or the like, can be used as the resin section **40*a*. In addition, a metal that is formed from gold (Au), titanium (Ti), aluminum (Al) chromium (Cr), nickel (Ni), copper (Cu), an alloy thereof, or the like, can be used as the electrode layer 40*b*. Additionally, each electrode layer 40*b* corresponds to lower surface side wiring 47 that is separated on the inner side (the side of the piezoelectric element 32) at the lower surface of the sealing plate 33 and runs along a direction that is orthogonal to the nozzle row direction from above the resin section 40*a*. The lower surface side wiring 47 is wiring that connects the resin core bumps 40 and the penetration wiring 45 (described later), and runs from a position that corresponds to the electrode layer 40*b* above the resin section 40*a* to a position that corresponds to the penetration wiring 45. In other words, a portion of the lower surface side wiring 47 that is formed on the lower surface of the sealing plate 33 forms the electrode layer 40*b* of the resin core bump 40 as a result of running along a direction that is orthogonal the nozzle row direction from a position that corresponds to the penetration wiring 45 to above the resin section 40***a*.

In addition, as shown in FIG. 2, a plurality (four in the present embodiment) of pieces of power source wiring 53 that supplies a power source voltage, and the like (for example, VDD1 (power source of a low voltage circuit), VDD2 (power source of a high voltage circuit), VSS1 (power source of a low voltage circuit), and VSS2 (power source of a high voltage circuit)) to the driving IC 34, are formed in a central section on the upper surface of the sealing plate 33 (a region that is separated from regions that correspond to the resin core bumps 40). The power source wiring 53 is formed from upper surface embedded wiring 50 that is buried in the upper surface of the sealing plate 33, and upper surface side wiring 46 that is laminated in a manner that covers the upper surface embedded wiring 50. Power source bump electrodes 56 of the corresponding driving IC 34 are electrically connected to the top of the upper surface side wiring 46 of the power source wiring 53. Additionally, the upper surface embedded wiring 50 is formed from a metal such as copper (Cu).

Furthermore, as shown in FIG. 2, driving bump electrodes 57 of the driving IC 34 are connected, and connection terminals 54 into which signals from the driving IC 34 are input, are formed, in regions of both end sides on the upper surface of the sealing plate 33 (to explain in more detail, regions that are separated on the outer sides from regions in which the power source wiring 53 are formed, and that correspond to the resin core bumps 40). The connection terminals 54 are formed in a plurality along the nozzle row direction corresponding to the piezoelectric elements 32. The upper surface side wiring 46 runs toward the inner side (a side of the piezoelectric elements 32) from each connection terminal 54. End sections of the upper surface side wiring 46 on a side that is opposite to the side of the connection terminals 54 are connected to lower surface side wiring 47 via the penetration wiring 45.

As shown in FIG. 2, the penetration wiring 45 is wiring that relays between the lower surface and the upper surface of the sealing plate 33, and is formed from a through hole 45*a* that penetrates through the sealing plate 33 in a thickness direction, and a conductor section 45*b* that is formed on an inner side of the through hole 45*a* and is formed from a conductor such as a metal. The conductor section 45*b* of the present embodiment is formed from a metal such as copper (Cu), and the through hole 45*a* is filled with the conductor section 45*b*. A portion of the conductor section 45*b* that is exposed to the opening section on the lower surface side of the through hole 45*a* is covered by the lower surface side wiring 47. Meanwhile, a portion of the conductor section 45*b* that is exposed to the opening section on the upper surface side of the through hole 45*a* is covered by the upper surface side wiring 46. The upper surface side wiring 46, which runs from a connection terminal 54, and a corresponding lower surface side wiring 47, which runs from a resin core bump 40, are electrically connected by the penetration wiring 45. That is, a connection terminal 54 and a corresponding resin core bump 40 are connected by a series of wiring that is formed from the upper surface side wiring 46, the penetration wiring 45 and the lower surface side wiring 47. Additionally, the inside of the through hole 45*a* need not necessarily be filled with the conductor section 45*b* of the penetration wiring 45, and it is sufficient if the conductor section 45*b* is formed in at least a portion inside the through hole 45*a*.

As shown in FIGS. 2 and 3, such a sealing plate 33 and pressure-chamber-defining substrate 29 (to explain in more detail, a pressure-chamber-defining substrate 29 on which the vibration plate 31 is laminated) are joined by a photosensitive adhesive agent 43 that has a both a thermosetting property and a photosensitive property in a state in which the resin core bumps 40 are interposed therebetween. In the present embodiment, the photosensitive adhesive agent 43 is formed on both sides of each resin core bump 40 in a direction that is orthogonal to the nozzle row direction, and in a position that corresponds to a space between rows of the pressure chambers 30. In addition, each photosensitive adhesive agent 43 is formed in strip shape along the nozzle row direction in a state of being separated from the resin core bumps 40. Additionally, for example, a resin that includes an epoxy resin, an acrylic resin, a phenol resin, a polyimide resin, a silicone resin, a styrene resin, or the like, as a main component may be suitably used as the photosensitive adhesive agent 43.

The driving IC 34, which is disposed on the sealing plate 33, is an IC chip that outputs signals for driving the piezoelectric elements 32, and is laminated on a surface on a side of the sealing plate 33 that is opposite to the piezoelectric elements 32 using an adhesive agent 59 such as an anisotropic conductive film (ACF). As shown in FIG. 2, the power source bump electrodes 56 that are connected to the power source wiring 53 and the driving bump electrodes 57 that are connected to the connection terminals 54, are provided in a plurality along the nozzle row direction on the surface of a side of the sealing plate 33 of the driving IC 34. The power source bump electrodes 56 are terminals take in a voltage (power) from the power source wiring 53 to a circuit inside the driving IC 34. In addition, the driving bump electrodes 57 is a terminal that outputs a signal that drives each piezoelectric element 32. The driving bump electrodes 57 in the present embodiment are formed in two rows on both sides of the power source bump electrodes 56 to correspond to a row of the piezoelectric elements 32 in which two pressure chambers 30 are arranged in parallel.

Further, a recording head 3, which is formed in the above-mentioned manner introduces ink from the ink cartridges 7 to the pressure chambers 30 through the liquid introduction paths 18, the common liquid chambers 25 and the individual communication channels 26. In this state, the piezoelectric elements 32 are driven and pressure fluctuations are generated in the pressure chambers 30 by supplying driving signals from the driving IC 34 to the piezoelectric elements 32 through each piece of wiring that is formed on the sealing plate 33. The recording head 3 ejects ink droplets from the nozzles 22 through the nozzle communication channels 27 using the pressure fluctuations.

Additionally, the configuration of the piezoelectric device 14 is not limited to a configuration in which the driving IC 34 is laminated on the sealing plate 33 in the manner of the present embodiment. For example, a configuration in which a driving IC is not laminated and a direct drive circuit is formed on the front surface of a sealing plate, can also be used. In other words, it is possible to use a driving IC in which a drive circuit is formed as the sealing plate. In addition to this, a configuration in which a TCP (Tape Carrier Package) in which a driving IC is mounted is connected to an upper surface of a sealing plate, can also be used.

Figure 4A:
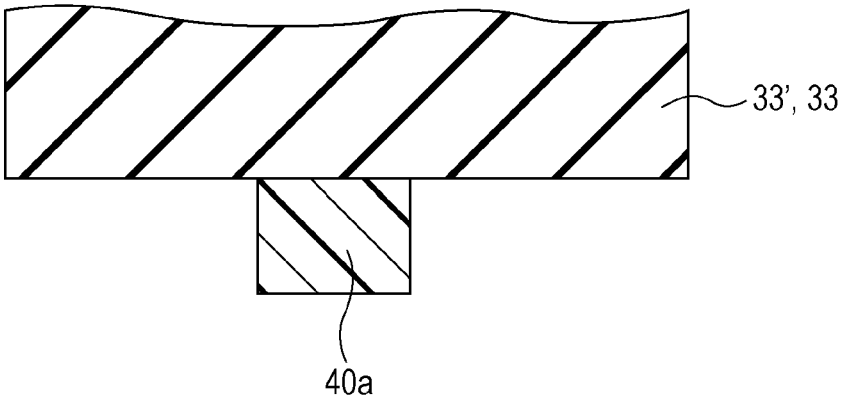
FIGS. 4A to 4C are schematic diagrams that describe manufacturing steps of a resin core bump.
Figure 4B:
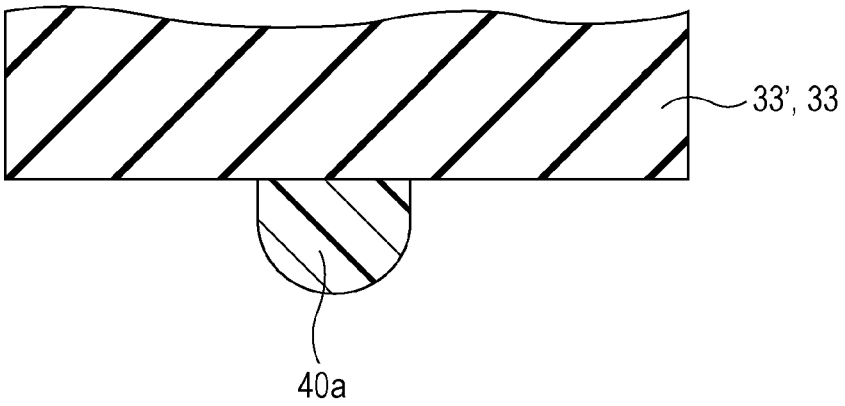
Figure 4C:
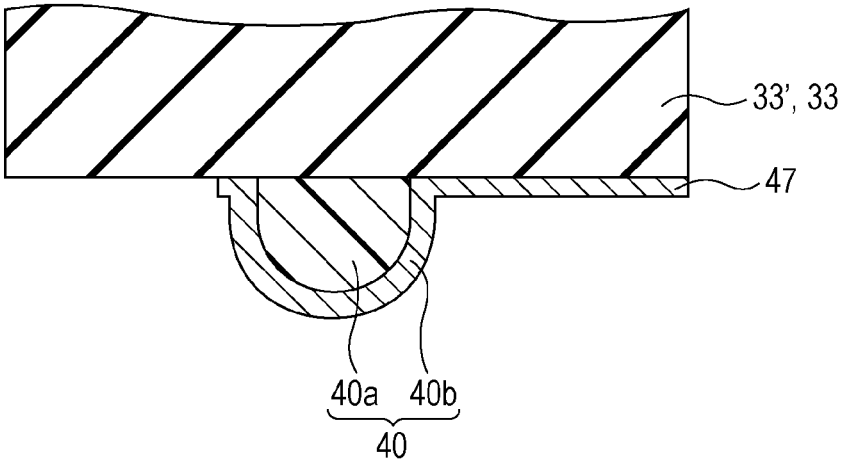

Next, a method for manufacturing the recording head 3 mentioned above, and in particular, a method for manufacturing the piezoelectric device 14 will be described with reference to FIGS. 4A to 4C. Firstly, in a monocrystalline silicon substrate 33', which corresponds to the sealing plate 33, a concave section and the through hole 45*a* are formed using etching or the like in order to form the upper surface embedded wiring 50. Further, the upper surface embedded wiring 50 and the conductor section 45*b* (that is, the penetration wiring 45) are formed by forming a conductive material inside the concave section and the through hole 45*a* using an electrolytic plating method. Additionally, the conductive material is deposited in excess on the monocrystalline silicon substrate 33' that corresponds to the sealing plate 33 using an electrolytic plating method, but the excess in removed using a Chemical Mechanical Polishing (CMP) method.

Next, the resin core bump 40 is formed. Firstly, in a resin section formation step, the resin section 40*a*, which corresponds to the elastic member, is provided in a protruding shape on the lower surface of the monocrystalline silicon substrate 33', which corresponds to the sealing plate 33. More specifically, a resin film is produced on the lower surface of the monocrystalline silicon substrate 33', which corresponds to the sealing plate 33, and the resin is patterned in a position that corresponds to the resin section 40*a* using etching. As a result of this, as shown in FIG. 4A, the resin section 40*a*, which has a substantially rectangular shape in a cross-sectional view is provided on the lower surface of the monocrystalline silicon substrate 33' in a shape protruding in a direction that is orthogonal to the nozzle row direction. Thereafter, the resin section 40*a* in which the tip end section is curved is formed by rounding the angles thereof through heating the resin section 40*a* and the monocrystalline silicon substrate 33' to approximately 400 degrees, for example, using a heating process. That is, as shown in FIG. 4B, the resin section 40*a* in which the lower surface (a surface on a side that is opposite to the monocrystalline silicon substrate 33') is curved in an arc shape toward the outer sides thereof, is formed. Thereafter, in a lower surface side wiring formation step (corresponds to the forming of a first electrode layer in the invention), the lower surface side wiring 47 is formed on the lower surface of the monocrystalline silicon substrate 33', and the electrode layer 40*b* is formed along the front surface of the resin section 40*a* using a semiconductor process. As a result of this, the resin core bump 40, in which the lower surface is curved in arc shape in a cross-sectional view, in a direction that is orthogonal to the nozzle row direction. In addition, the upper surface side wiring 46 is formed in regions that cover the upper surface embedded wiring 50, and the like, on the upper surface of the monocrystalline silicon substrate 33', which corresponds to the sealing plate 33. As a result of this, the sealing plate 33 that is shown in FIG. 2 is created.

Meanwhile, in the monocrystalline silicon substrate, which corresponds to the pressure-chamber-defining substrate 29, firstly, the vibration plate 31 is laminated on the upper surface (a surface on a side that opposes the sealing plate 33). Next, in a piezoelectric element formation step, the piezoelectric element 32 is formed by sequentially patterning the lower electrode layer, the piezoelectric body layer, the upper electrode layer and the like, and the driving wiring 37 is formed in regions that correspond to the electrode layer 40*b* of the resin core bumps 40 using a semiconductor process. That is, in a driving wiring formation step (corresponds to the forming of a second electrode layer of the invention) that is included in the piezoelectric element formation step, the driving wiring 37 is formed using a semiconductor process. Further, when the piezoelectric element 32, the driving wiring 37, and the like, have been formed, the process moves to a substrate joining step that joins the monocrystalline silicon substrate 33', which corresponds to the sealing plate 33, and the monocrystalline silicon substrate, which corresponds to the pressure-chamber-defining substrate 29.

In the substrate joining step, firstly, a photosensitive adhesive agent layer is formed on the upper surface of the monocrystalline silicon substrate, which corresponds to the pressure-chamber-defining substrate 29 (a surface on a side that opposes the sealing plate 33), and the photosensitive adhesive agent 43 is formed in predetermined positions by exposing and developing the photosensitive adhesive agent layer. Additionally, the photosensitive adhesive agent can be formed in predetermined positions on the lower surface of the monocrystalline silicon substrate, which corresponds to the sealing plate 33. When the photosensitive adhesive agent 43 has been formed, the monocrystalline silicon substrate 33', which corresponds to the sealing plate 33, and the monocrystalline silicon substrate, which corresponds to the pressure-chamber-defining substrate 29, are joined in a state in which the driving wiring 37 and the corresponding electrode layer 40*b* of the resin core bump 40 are abutting against each other. More specifically, the photosensitive adhesive agent 43 is stuck together interposed between the two monocrystalline silicon substrate by relatively moving either one of the monocrystalline silicon substrate toward the side of the other monocrystalline silicon substrate. In this state, a pressing force is applied to the two monocrystalline silicon substrates from the up-down direction by resisting the elastic restoring force of the resin core bump 40. As a result of this, a joining area of the electrode layer 40*b* and the driving wiring 37 is increased as a result of the resin core bump 40 being crushed (elastically deformed), it is possible to reliably electrically connect to the driving wiring 37 of the side of the pressure-chamber-defining substrate 29 as a result. Further, while a pressing force is being applied, the photosensitive adhesive agent 43 is heated to the curing temperature of the photosensitive adhesive agent 43, for example, approximately 200 degrees. As a result of this, the two monocrystalline silicon substrates are pasted together by curing the photosensitive adhesive agent 43 in a state in which the resin core bump 40 is elastically deformed due to being crushed.

When both monocrystalline silicon substrates have been joined, the monocrystalline silicon substrate of the side of the pressure-chamber-defining substrate 29 is polished from the lower surface side (a side that is opposite to the sealing plate 33), and the monocrystalline silicon substrate of the side of the pressure-chamber-defining substrate 29 is thinned. Thereafter, the pressure chambers 30 are formed in the thinned monocrystalline silicon substrate of the side of the pressure-chamber-defining substrate 29 using etching. As a result of this, the pressure-chamber-defining substrate 29 that is shown in FIG. 2 is created, and a joined structure in which the pressure-chamber-defining substrate 29 and the sealing plate 33 are pasted together is created. When such a joined structure has been created, the driving IC 34 is joined to the upper surface of the sealing plate 33 (a surface on a side that is opposite to the pressure-chamber-defining substrate 29) using the adhesive agent 59. As a result of this, the piezoelectric device 14 is created. Additionally, the adhesive agent 59 is a conductive adhesive agent such as ACF, and when the driving IC 34 is joined in a state of being positioned on the sealing plate 33, the power source bump electrodes 56 and the pieces of power source wiring 53 are electrically connected, and the driving bump electrodes 57 and connection terminals 54 are electrically connected.

Further, the piezoelectric device 14 that is created in the above-mentioned manner is positioned and fixed onto the flow channel unit 15 (the communication substrate 24) using an adhesive agent or the like. Further, the above-mentioned recording head 3 is manufactured by joining the head case 16 and the flow channel unit 15 in a state in which the piezoelectric device 14 is accommodated in the accommodation space 17 of the head case 16.

In this manner, since the bumps, which are connected to the driving wiring 37, are formed using the resin core bumps 40, which are formed from the resin section 40*a* and the electrode layer 40*b*, and the these components are connected as a result of the resin section 40*a* being elastically deformed, in comparison with a case of connecting a metal bump, which is formed from a metal, to the driving wiring 37, it is possible to relatively electrically connect the driving wiring 37 and the electrode layer 40*b* even is the pressure that is applied between the pressure-chamber-defining substrate 29 and the sealing plate 33 is reduced. As a result of this, when joining the driving wiring 37 and the resin core bumps 40, it is possible to reduce the pressure that is applied between the pressure-chamber-defining substrate 29 and the sealing plate 33. Due to this, it is possible to suppress a circumstance in which fractures and cracks occur (that is, breaking) in the pressure-chamber-defining substrate 29 or the sealing plate 33. In particular, it is possible to suppress breaking of the sealing plate 33, the strength of which has a tendency to be comparatively low, can be suppressed as a result of forming the penetration wiring 45. In addition, since the front surface of the side of the pressure-chamber-defining substrate 29 of the resin section 40*a* and the electrode layer 40*b* is formed curved in an arc shape toward the side of the pressure-chamber-defining substrate 29, it is easier for the resin core bump 40 to elastically deform. As a result of this, it is possible to further reduce the pressure that is applied between the pressure-chamber-defining substrate 29 and the sealing plate 33.

Figure 5:
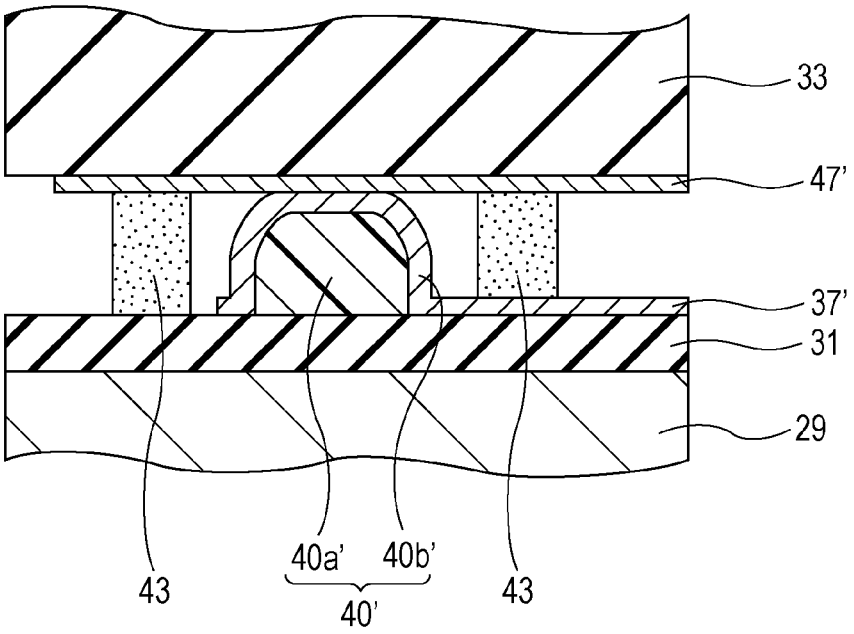
FIG. 5 is a cross-sectional view in which the main parts of a recording head in a second embodiment are enlarged.

Given that, in the above-mentioned first embodiment, the resin core bumps 40 are formed on the side of the sealing plate 33, but the invention is not limited to this configuration. For example, in a second embodiment that is shown in FIG. 5, a resin core bump is not formed on the side of the sealing plate 33, and a resin core bumps 40' is formed on the side of the pressure-chamber-defining substrate 29. That is, in the second embodiment, the resin section is not formed on the sealing plate 33, and lower surface side wiring 47' is formed along the lower surface of the sealing plate 33. Further, the lower surface side wiring 47' runs from a position that corresponds to the penetration wiring 45 to a position that corresponds to the resin core bump 40' on the side of the pressure-chamber-defining substrate 29, and the resin core bump 40' forms a terminal to be connected. Meanwhile, a resin section 40*a'* is formed on the pressure-chamber-defining substrate 29 in a non-driving region that is further on an outer side than the piezoelectric element 32. The driving wiring 37' that extends from the piezoelectric element 32 configures the resin core bump 40' by extending up to a position that overlaps with the resin section 40*a'*. That is, the electrode layer 40*b'* is formed as a result of the driving wiring 37' being formed along the upper surface of the resin section 40*a'* (a surface on the side of the sealing plate 33). Additionally, in the present embodiment, the electrode layer 40*b'* that is formed by the driving wiring 37' corresponds to the first electrode layer of the invention, and the corresponding lower surface side wiring 47' corresponds to the second electrode layer of the invention. In addition, since the other configurations are the same as those of the first embodiment, description thereof will be omitted.

Next, a method for manufacturing the piezoelectric device 14 in the present embodiment will be described. Firstly, a concave section and the through hole 45*a* are formed on a monocrystalline silicon substrate, which corresponds to the sealing plate 33, and the upper surface embedded wiring 50 and the conductor section 45*b* (that is, the penetration wiring 45) are formed using the same methods as the first embodiment. Next, in a lower surface side wiring formation step (in the present embodiment, corresponds to the forming of a second electrode layer in the invention), the lower surface side wiring 47' is formed on the lower surface of the monocrystalline silicon substrate, which corresponds to the sealing plate 33 using a semiconductor process. In addition, the upper surface side wiring 46 is formed on the upper surface of the monocrystalline silicon substrate, which corresponds to the sealing plate 33. As a result of this, the sealing plate 33 is created.

Meanwhile, in the monocrystalline silicon substrate, which corresponds to the pressure-chamber-defining substrate 29, firstly, the vibration plate 31 is laminated on the upper surface (a surface on a side that opposes the sealing plate 33). Next, in a resin section formation step, the resin section 40*a'* is provided in a protruding shape on the upper surface of the monocrystalline silicon substrate, which corresponds to the pressure-chamber-defining substrate 29. That is, the resin section 40*a'*, which has a substantially rectangular shape in a cross-sectional view is provided in a shape protruding in a direction that is orthogonal to the nozzle row direction using the same method as that of the first embodiment. Thereafter, the resin section 40*a'* in which the tip end section is curved is formed by rounding the angles thereof using a heating process. That is, a resin section 40*a'* in which the upper surface is curved in an arc shape toward the outer side, is formed. When the resin section 40*a'* has been formed, in the piezoelectric element formation step, the piezoelectric element 32 is formed by sequentially patterning the lower electrode layer, the piezoelectric body layer, the upper electrode layer and the like, and the driving wiring 37' and the electrode layer 40*b'* are formed using a semiconductor process. That is, in a driving wiring formation step (in the present embodiment, corresponds to the forming of a first electrode layer of the invention) that is included in the piezoelectric element formation step, the driving wiring 37' and the electrode layer 40*b'* are formed using a semiconductor process. As a result of this, the resin core bump 40' is formed, and the pressure-chamber-defining substrate 29 that is shown in FIG. 5 is created.

In a subsequent substrate joining step, firstly, the photosensitive adhesive agent 43 is formed in predetermined positions on the lower surface of the monocrystalline silicon substrate, which corresponds to the sealing plate 33 using the same method as the first embodiment. Additionally, the photosensitive adhesive agent can be formed in predetermined positions on the upper surface of the monocrystalline silicon substrate, which corresponds to the pressure-chamber-defining substrate. Thereafter, in the same manner as the first embodiment, the monocrystalline silicon substrate, which corresponds to the sealing plate 33, and the monocrystalline silicon substrate, which corresponds to the pressure-chamber-defining substrate 29, are joined in a state in which the lower surface side wiring 47' and the corresponding electrode layer 40*b'* of the resin core bump 40' are abutting against each other. When both monocrystalline silicon substrates have been joined, the monocrystalline silicon substrate of the side of the pressure-chamber-defining substrate 29 is polished, and the pressure chambers 30 are formed using the same methods as those of the first embodiment. Further, the driving IC 34 is joined to the upper surface of the sealing plate 33. As a result of this, the piezoelectric device 14 in the present embodiment is created.

In this manner, in the present embodiment, since the resin core bump 40' is formed on the pressure-chamber-defining substrate 29, in a heating step that is included in the resin section formation step, even if heat is applied to the side of the pressure-chamber-defining substrate 29, since penetration wiring such as that which is formed in the sealing plate 33 has not been formed in the pressure-chamber-defining substrate 29, a circumstance in which the pressure-chamber-defining substrate 29 breaks due to heating does not occur. That is, in a case in which heat is applied to the side of the sealing plate 33 (the monocrystalline silicon substrate, which corresponds to the sealing plate 33), it is thought that the sealing plate 33 will break as a result of a difference in the linear expansion coefficients of the conductor section 45*b* of the penetration wiring 45 that is formed in the sealing plate 33 and the corresponding sealing plate 33. Therefore, in the heating step, a countermeasure of keeping a heating temperature low by making a heating time longer, and limiting the materials that are used in the conductor section 45*b* to materials that have a similar linear expansion coefficient to that of the sealing plate 33, can also be considered. However, in the present embodiment, since the resin core bumps, that is, the resin section, is not formed on the side of the sealing plate 33, in the heating step, heat of a high temperature is not applied to the side of the sealing plate 33, thereby making it possible to suppress such breakage. Further, it is not necessary to keeping a heating temperature in the heating step low, or limiting the materials that are used in the conductor section to materials that have a similar linear expansion coefficient to that of the sealing plate, in order to suppress such breakage. As a result of this, the manufacture of the piezoelectric device 14 is facilitated.

In addition, in each of the above-mentioned embodiments, the front surfaces of the resin core bumps 40 and 40' (the resin sections 40*a* and 40*a*', and the electrode layers 40*b* and 40*b*') are formed by being bent in an arc shape, but the invention is not limited to this configuration. In essence, as long as the surface is a curved surface that includes a portion in which at least a part of the front surface is curved in an arc shape, and is connected to a corresponding electrode in a state in which at least a part thereof is elastically deformed, the surface may have any shape.

Further, an example of the piezoelectric device 14 that is assembled in the recording head 3 is described above as an example of the piezoelectric device of the invention, but the invention can also be applied to piezoelectric devices that are provided in other items of electronic equipment. For example, the invention can also be applied to a piezoelectric device that causes a piezoelectric element to function as a sensor. In addition, for example, it is also possible to apply the invention to color material ejecting heads that are used in the production of color filters such as liquid crystal displays, electrode material ejecting heads that are used in electrode formation such as organic Electro Luminescence (EL) displays, Field Emission Displays (FEDs) and the like, and living organic material ejecting heads that are used in the production of biochips (biochemical elements), and the like.

What is claimed is:

1. A piezoelectric device comprising:

a first substrate having a piezoelectric element on one surface thereof; and a second substrate having penetration wiring that includes a through hole formed in a thickness direction thereof and a conductor section formed in the through hole, wherein a resin section is formed on a surface of one substrate of one of the first substrate and the second substrate, which opposes the other substrate, and is formed of an elastic body in a shape protruding toward the other substrate; and a first electrode layer is formed on the surface of the other substrate side of the resin section, wherein a second electrode layer, which is electrically connected to the first electrode layer, is formed on a surface of the other substrate that opposes the one substrate, wherein the first substrate and the second substrate are joined in a state in which the first electrode layer and the second electrode layer are abutting against each other, and wherein a part of the resin section protruding toward the second electrode layer is disposed between the one substrate and the first electrode layer.

2. The piezoelectric device according to claim 1, wherein a curved surface of the resin section and the first electrode layer opposing the other substrate includes a portion that is curved in an arc shape.

3. A liquid ejecting head comprising:

the piezoelectric device according to claim 2.

4. The piezoelectric device according to claim 1, wherein the resin section and the first electrode layer are formed on the first substrate, and wherein the second electrode layer is formed on the second substrate.

5. A liquid ejecting head comprising:

the piezoelectric device according to claim 4.

6. A liquid ejecting head comprising:

the piezoelectric device according to claim 1.

* * * * *